US008298313B2

(12) United States Patent
Jesner et al.

(10) Patent No.: US 8,298,313 B2
(45) Date of Patent: Oct. 30, 2012

(54) COLD-FORMING STEEL ARTICLE

(75) Inventors: Gerhard Jesner, Seckau (AT); Devrim Caliskanoglu, Bruck/Mur (AT)

(73) Assignee: Boehler Edelstahl GmbH & Co KG, Kapfenberg (AT)

( * ) Notice: Subject to any disclaimer, the term of this patent is extended or adjusted under 35 U.S.C. 154(b) by 418 days.

(21) Appl. No.: 12/718,523

(22) Filed: Mar. 5, 2010

(65) Prior Publication Data

US 2010/0233500 A1 Sep. 16, 2010

(30) Foreign Application Priority Data

Mar. 12, 2009 (AT) ..... 402/2009

(51) Int. Cl.

| | |
|---|---|
| ***B22F 3/15*** | (2006.01) |
| ***C22C 33/02*** | (2006.01) |
| ***C22C 38/22*** | (2006.01) |
| ***C22C 38/24*** | (2006.01) |
| ***B32B 15/02*** | (2006.01) |

(52) U.S. Cl. ..... 75/243; 75/246; 419/28; 419/29; 419/49; 428/548; 428/552; 428/698

(58) Field of Classification Search ..... 75/243, 75/246; 419/28, 29, 49; 428/548, 552, 698
See application file for complete search history.

(56) References Cited

U.S. PATENT DOCUMENTS

| | | | | |
|---|---|---|---|---|
| 3,809,541 | A * | 5/1974 | Steven | 75/236 |
| 4,936,911 | A * | 6/1990 | Roberts et al. | 75/238 |
| 5,252,119 | A * | 10/1993 | Nishida et al. | 75/236 |
| 5,753,005 | A * | 5/1998 | Aoki et al. | 75/255 |
| 6,773,482 | B2 * | 8/2004 | Liebfahrt et al. | 75/243 |
| 7,615,123 | B2 * | 11/2009 | Kajinic et al. | 148/321 |
| 7,682,417 | B2 * | 3/2010 | Schemmel et al. | 75/246 |
| 2003/0095886 | A1 * | 5/2003 | Maili et al. | 419/68 |

* cited by examiner

*Primary Examiner* — Roy King
*Assistant Examiner* — Ngoclan T Mai
(74) *Attorney, Agent, or Firm* — Greenblum & Bernstein, P.L.C.

(57) ABSTRACT

A cold-forming steel article which comprises an alloy that comprises carbon, manganese, silicon, chromium, molybdenum, vanadium, tungsten and optionally, niobium in certain concentrations, as well as up to about 0.4 wt. % of accompanying elements, remainder iron and contaminants. The article is formed by atomization of a melt and hot isostatic pressing of the resultant powder. The article exhibits a hardness of at least about 60 HRC and a toughness in terms of impact strength of higher than about 50 J. This abstract is neither intended to define the invention disclosed in this specification nor intended to limit the scope of the invention in any way.

20 Claims, 3 Drawing Sheets

COLD-FORMING STEEL ARTICLE

CROSS-REFERENCE TO RELATED APPLICATIONS

The present application claims priority under 35 U.S.C. §119 of Austrian Patent Application No. A 402/2009, filed on Mar. 12, 2009, the entire disclosure of which is expressly incorporated by reference herein.

BACKGROUND OF THE INVENTION

1. Field of the Invention

The present invention relates to a cold-forming steel article, in particular a tool with a large tempering depth or high full quenching and tempering capacity, which contains the alloying elements carbon, manganese, silicon, chromium, molybdenum, vanadium and tungsten, optionally the element niobium, as well as accompanying elements with a content of less than about 0.4% by weight, the remainder being contaminants and iron.

In particular, the invention relates to a tool that is coated with hard material at a temperature of higher than about 500° C.

2. Discussion of Background Information

Cold-forming steels are alloys that in the heat-treated state have a property profile with great hardness, high wear resistance and high material toughness, wherein a good workability and special dimensional stability during hardening and tempering represent important criteria. These cold-forming steels are used among other things as tools in punching technology of plastic molding for fine blanking as die parts and the like. In terms of alloying, these cold-forming steel materials are generally designed for tool production and the principal stress criteria in practical use.

A hardness of preferably at least about 60 HRC and a high carbide content with uniform distribution of the carbides in a high-strength matrix of the material are important for a high wear or abrasion resistance and a high dimensional stability of tools. However, it should be possible to use a simple tempering technology for the parts, wherein a desired deep hardness generation of the material under the quenching surface is necessary.

For tools or parts on which a particular hard material layer, e.g., a nitride, carbonitride or oxidecarbide layer of the elements titanium, chromium, aluminum and the like, is to be applied at a coating temperature of higher than 500° C., furthermore the substrate, that is, the cold-forming steel article, must withstand this thermal stress over the necessary or required coating period or must not exhibit a major decrease in the property values, in particular the hardness and toughness of the material.

In view of the requirements regarding a comprehensively improved property profile in a cold-forming steel article, it would be advantageous to have available a heat-treated material which from conventional temperatures which are easily set between about 1030° C. and about 1080° C. with intensified cooling to large depths is converted into a martensitic microstructure, provides high material hardness and toughness during tempering and is resistant to softening up to temperatures of over 500° C. with treatment times of up to several hours and has a high wear resistance.

SUMMARY OF THE INVENTION

The present invention provides a cold-forming steel article which comprises an alloy that comprises, in % by weight based on the total weight of the alloy:

C from about 1.1 to about 1.7
Mn from about 0.1 to about 0.6
Si from about 0.4 to about 1.1
Cr from about 5.6 to about 7.0
Mo from about 1.2 to about 1.8
V from about 3.5 to about 3.9
W from about 1.1 to about 5.0 and optionally niobium as well as less than about 0.4 wt. % of accompanying elements, the remainder being iron and contaminants. The article is formed by a process which comprises the atomization of a melt and a hot isostatic pressing (HIP) of the powder produced thereby. Further, the article is hardened by a heat treatment and exhibits a material hardness of at least about 60 HRC and a material toughness, measured in terms of impact strength according to SEP (Stahl Eisen Prüfblatt=Steel Iron Testing Standard) 1314, of higher than about 50 J.

In one aspect of the article, the alloy may comprise up to about 1.0 wt. % of Nb with the proviso that $W_{Nb}$ is lower than about 88, $W_{Nb}$ being defined as $$W_{Nb} = \frac{(Mo + W/2) + V}{Nb}$$

In another aspect of the article, the alloy may comprise, in % by weight based on the total weight of the alloy, at least one of:

C=from more than about 1.2 to less than about 1.6
Mn=from more than about 0.2 to less than about 0.55
Si=from more than about 0.45 to less than about 1.0
Cr=from more than about 5.7 to less than about 6.9
Mo=from more than about 1.3 to less than about 1.7
V=from more than about 3.55 to less than about 3.9
W=from more than about 1.9 to less than about 4.5
Nb=from more than about 0.1 to less than about 0.9.

For example, the alloy may comprise one or more (e.g., all) of:

C=from about 1.35 to about 1.55
Mn=from about 0.3 to about 0.5
Si=from about 0.5 to about 0.9
Cr=from about 5.8 to about 6.5
Mo=from about 1.4 to about 1.6
V=from about 3.6 to about 3.8
W=from about 3.1 to about 4.4
Nb=from about 0.4 to about 0.75.

In yet another aspect, the article may have a coating on a surface thereof, which coating has been applied during tempering at a temperature of at least about 500° C. For example, the coating may comprise a hard material coating such as, e.g., a hard material coating that comprises at least one of a nitride, carbonitride, and oxidecarbide of one or more of Ti, Cr and Al.

In a still further aspect, the article may exhibit a material hardness of greater than about 62 HRC, e.g., a material hardness of from about 63 to about 65 HRC and/or the article may exhibit a material toughness of greater than about 60 J, e.g., greater than about 65 J.

In another aspect, the article may comprise a hard material coating on a surface thereof, which coating was applied at a temperature of at least about 550° C.

In another aspect, the article may comprise a tool.

The present invention also provides a process for making a cold-forming steel article. The process comprises an atomization of an alloy melt and a hot isostatic pressing (HIP) of the powder obtained thereby and a hardening of the article by a heat treatment to a material hardness of at least about 60 HRC and a material toughness of higher than about 50 J. The alloy comprises, in % by weight based on the total weight of the alloy:

C from about 1.1 to about 1.7
Mn from about 0.1 to about 0.6
Si from about 0.4 to about 1.1
Cr from about 5.6 to about 7.0
Mo from about 1.2 to about 1.8
V from about 3.5 to about 3.9
W from about 1.1 to about 5.0 and optionally niobium as well as less than about 0.4 wt. % of accompanying elements, the remainder being iron and contaminants.

In one aspect, the process may further comprise a hot forming of the article before hardening it.

In another aspect, the process may further comprise the application of a coating on a surface of the article during tempering at a temperature of at least about 500° C., e.g., at least about 550° C. The coating may comprise a hard material coating.

In yet another aspect of the process, the article may exhibit a material hardness of at least about 63 HRC and a material toughness of greater than about 60 J.

BRIEF DESCRIPTION OF THE DRAWINGS

The present invention is further described in the detailed description which follows, in reference to the drawings by way of non-limiting examples of exemplary embodiments of the present invention, and wherein.

DETAILED DESCRIPTION OF THE PRESENT INVENTION

Figure 1:
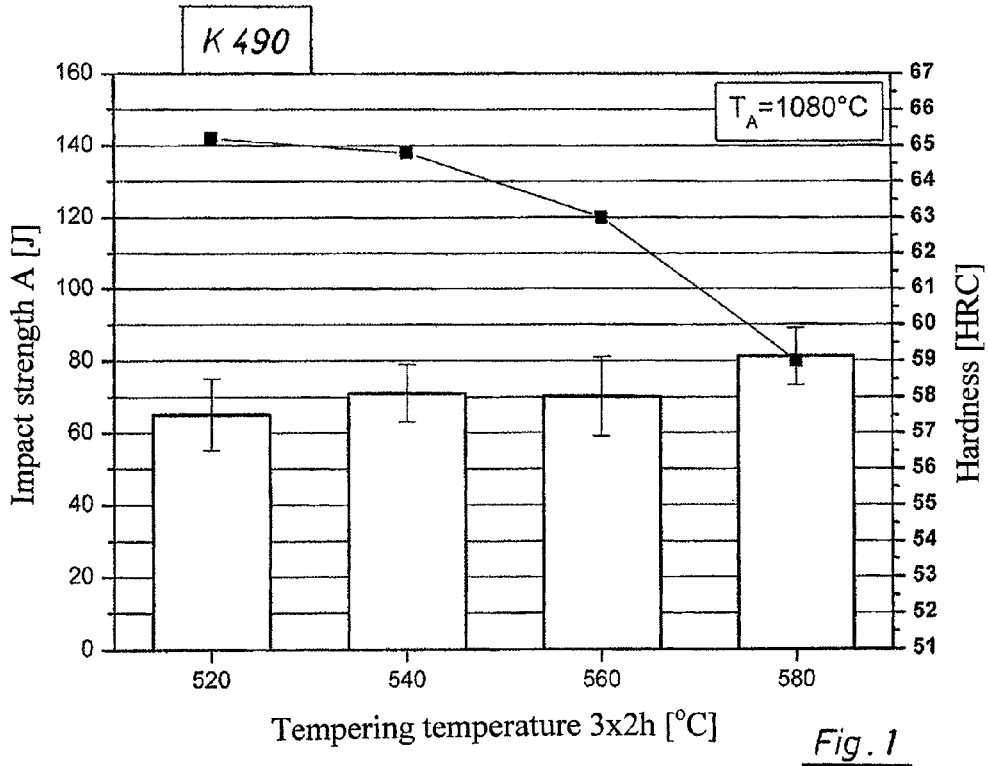
FIG. 1 is a graph representing the mean values of six identical tests of the impact strength and the hardness of an article made of a first alloy in accordance with the present invention, which article was hardened from an austenitizing temperature and tempered at four different temperatures three times for two hours.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

It was found that the alloying elements in their respectively provided concentration in the material, based on the interaction of the carbide formers with the carbon concentration are adjusted such that with a high solidification rate achieved with a powder metallurgical production the development of the carbide phases and the matrix solidification through atomic lattice strain provide high abrasion resistance and material strength with high resistance to softening and high material toughness.

The effectively carbide-forming elements of the fifth and sixth group of the Periodic Table, depending on the concentration, in particular carbon activity and temperature, form carbides with different crystal structures and properties in the matrix. In other words: MC, $M_4C_3$ and $M_{23}C_6$ type carbides having a cubic crystal structure and hexagonally or trigonally structured carbides of the $M_2C$ type with MC contents as well as $M_7C_3$ form according to the respective carbon activity corresponding to the respective concentration of the carbide-forming metal elements in interaction with the available free carbon content, whereby a specific quantitative distribution of the carbide types is adjusted in the matrix and a material-hardening lattice strain is achieved therein through free embedded alloy atoms.

Thus, in order to achieve a carbide formation and interaction of the elements in the form in which the desired material properties can be achieved in the product, with a carbon content of from about 1.1% to about 1.7% by weight it is important to adjust the respective concentrations in % by weight of the carbide formers in the steel, i.e., of chromium to from about 5.6 to about 7.0, of molybdenum to from about 1.2 to about 1.8, of vanadium to from about 3.5 to about 3.9 and of tungsten to from about 1.1 to about 5.0. Monocarbides, mixed carbides and a carbon concentration and element concentration are thus adjusted in the matrix with respect to the desired material properties The cold-forming steel article according to the invention, as one skilled in the art is aware, can be produced with a fine structure only with the powder metallurgical production of the material, which, where necessary also with hot working, produces the prerequisites for the desired material property profile, wherein a hardness of greater than about 60 HRC and a toughness in terms of impact strength of greater than about 50 J represent the lower limits.

With a particularly advantageous further development of the invention the steel contains up to about 1.0 wt. % of Nb with the proviso that the value $$W_{Nb} = \frac{(Mo + W/2) + V}{Nb}$$

is smaller than about 88, preferably smaller than about 39.

This alloying measure has a refining effect on the carbide grain size and is based, as was found, on the effect of Nb in the solidification of the homogeneous melt in the presence of carbon and other carbide-forming elements.

The elements vanadium, as a strong monocarbide former, as well as tungsten and molybdenum, which form $M_2C$ carbides and MC carbides, for the most part form larger mixed carbides. In contrast, niobium has only a slight tendency to form mixed carbides, therefore represents fine, homogeneously distributed monocarbides, which are highly effective as carbide nuclei and ultimately produce a small carbide grain size in the matrix.

When the concentration of at least one alloying element has the following values in % by weight:

C greater than about 1.2, less than about 1.6, preferably from about 1.35 to about 1.55

Mn greater than about 0.2, less than about 0.55, preferably from about 0.3 to about 0.5

Si greater than about 0.45, less than about 1.0, preferably from about 0.5 to about 0.9

Cr greater than about 5.7, less than about 6.9, preferably from about 5.8 to about 6.5

Mo greater than about 1.3, less than about 1.7, preferably from about 1.4 to about 1.6

V greater than about 3.55, less than about 3.9, preferably from about 3.6 to about 3.8

W greater than about 1.9, less than about 4.5, preferably from about 3.1 to about 4.4

Nb greater than about 0.1, less than about 0.9, preferably from about 0.4 to about 0.75 the property profile of the cold-forming steel article can be further improved. This relates in particular to the element tungsten in interaction with niobium in the range of narrow carbon activities.

As tests showed, the narrower the range of the chromium concentration is around a mean value of about 6.2, the more advantageously a microstructure formation results during the quenching and tempering, because on the one hand only a low stability of the residual austenite is given and on the other hand there is a high full quenching and tempering capacity.

A cold-forming steel article with outstanding properties can be produced in a highly economic manner if it has a coating on the working face, which coating is applied during tempering at a temperature of at least about 500° C., optionally about 550° C. and higher.

In this manner at least a tempering treatment can be carried out at the same time as a surface coating, and an excellent adhesive strength of the layer can be achieved. There is not yet a scientific explanation why a simultaneous application of a coating and a tempering treatment of the hardened article at over about 500° C. causes a higher adhesion of the wear layer.

When, advantageously for a high property profile, the cold-forming steel article has a material hardness of greater than about 62 HRC, in particular from about 63 to about 65 HRC, with a material toughness measured by an impact strength according to SEP 1314 of greater than about 50 J, in particular greater than about 55 J, the alloy can be used comprehensively with high stresses.

When following a heat treatment a hard material coating is applied to the article for an hour and longer at a temperature of over 500° C. to 550° C., no deterioration of the material properties occurs thereby.

The invention is explained in more detail below based on development results that represent only one way of carrying out the invention.

Two steels with similar chemical compositions, but different niobium contents, were selected from the tests.

Some test results are given below and, if necessary, compared. The composition of the alloys is shown in Table 1.

TABLE 1

| | Alloying elements in % by weight | | | | | | | | |
|---|---|---|---|---|---|---|---|---|---|
| Alloy | C | Si | Mn | Cr | Mo | V | W | Nb | Fe + contaminants |
| K490 | 1.47 | 0.82 | 0.34 | 6.28 | 1.57 | 3.86 | 4.09 | 0.01 | remainder |
| K490-So | 1.41 | 0.55 | 0.35 | 6.42 | 1.48 | 3.70 | 3.50 | 0.46 | remainder |

Table 2 shows the mean values of alloys K490 and K490-So of six identical tests of the impact strength A in [J] according to SEP 1314 and the measured hardness values in [HRC] of the materials, which were respectively hardened from an austenitizing temperature $T_A$ of 1080° C. and tempered at four different temperatures three times for two hours.

TABLE 2

| Tempering | K490 | | K490-So | |
|---|---|---|---|---|
| temperature [° C.] | Impact strength A [J] | Hardness [HRC] | Impact strength A [J] | Hardness [HRC] |
| 520 | 66.1 | 65.3 | 72.5 | 65.4 |
| 540 | 71.0 | 64.8 | 78.5 | 64.4 |
| 560 | 70.0 | 63.0 | 77.5 | 63.9 |
| 580 | 82.2 | 58.9 | 87.0 | 58.5 |

Figure 2:
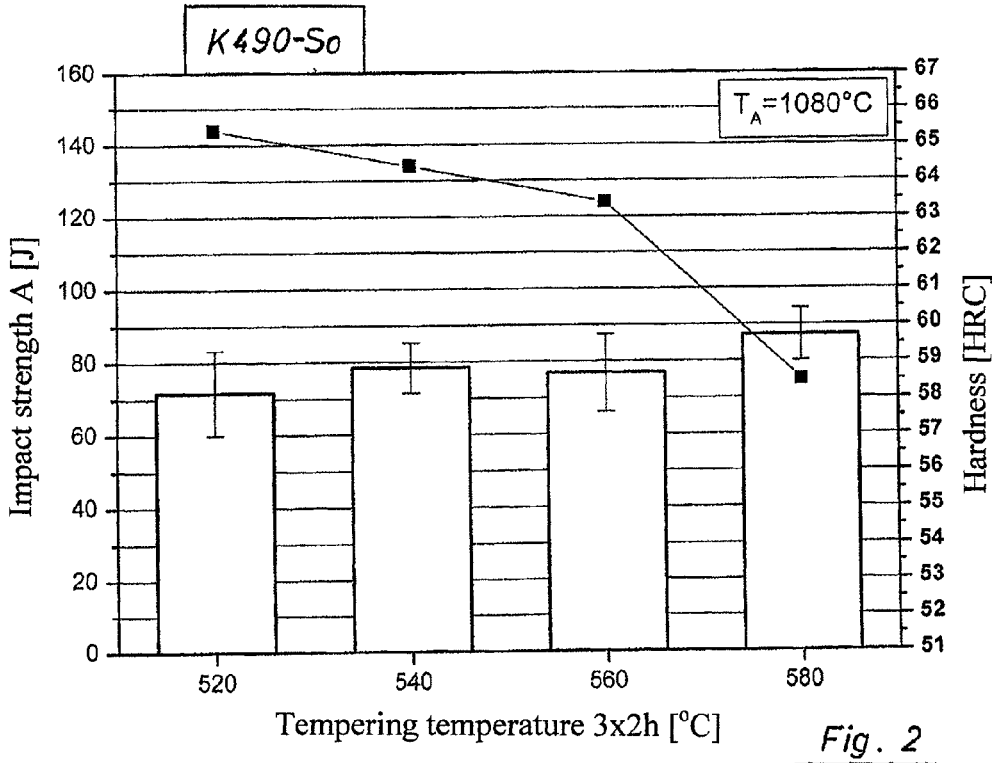
FIG. 2 is a graph representing the mean values of six identical tests of the impact strength and the hardness of an article made of a second alloy in accordance with the present invention, which article was hardened from an austenitizing temperature and tempered at four different temperatures three times for two hours.

FIGS. 1 and 2 show the values of Table 1 in graphical representation.

Based on the values of Table 2 and the graphical representation in FIG. 1 and FIG. 2, one skilled in the art recognizes a high material toughness of the alloys of the cold-forming steel according to the invention with tempering to higher than 60 HRC. As was found, this limit value of the hardness of 60 HRC, which is often made a condition of sale for many articles in practical use, can be achieved with a tempering at a temperature of up to about 570° C. with heating three times for a duration of 2 hours. This renders possible the use of coating methods for an application of hard material layers, which are carried out for kinetic reasons at high temperatures of about 540° C. and higher, and makes it possible to achieve the highest adhesive strength on the substrate and in this manner to substantially improve the service properties of cold-forming steel articles.

According to one embodiment of the invention, through the alloying of niobium (K490-So) in particular the toughness of the tempered material can be further increased with essentially the same hardness.

This can be attributed to a carbide grain refinement, as shown by tests with a high magnification of the microstructures.

Figure 3:
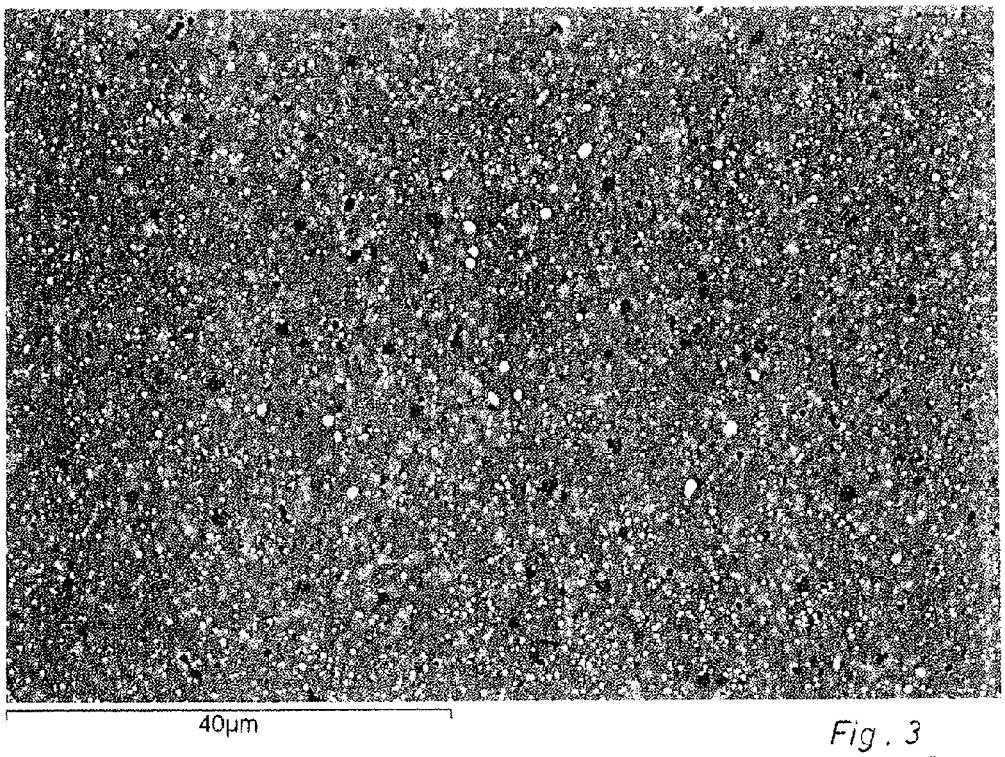
FIG. 3 is a microphotograph of the fine structure of a first material in accordance with the present invention which was achieved through a powder metallurgical (PM) production.

FIG. 3 shows by way of example the material K490 with a fine structure, which was achieved through a PM production.

Figure 4:
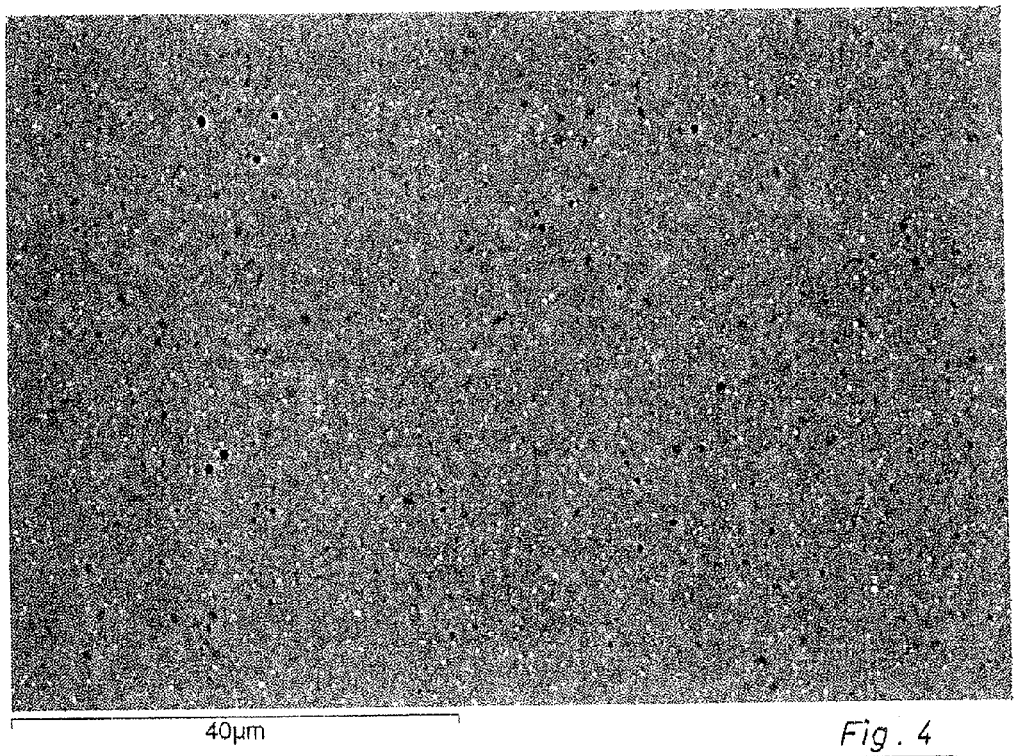
FIG. 4 is a microphotograph of the fine structure of a second material in accordance with the present invention which was achieved through a powder metallurgical (PM) production.

The size of the carbide particles, as shown by FIG. 4, can be reduced by alloying in the given case 0.46% by weight of Nb, which leads to an increase in the material toughness. This is associated with a quicker dissolution of carbides during the austenization of the material and a martensitic conversion during quenching to greater depths of the article.

Figure 5A:
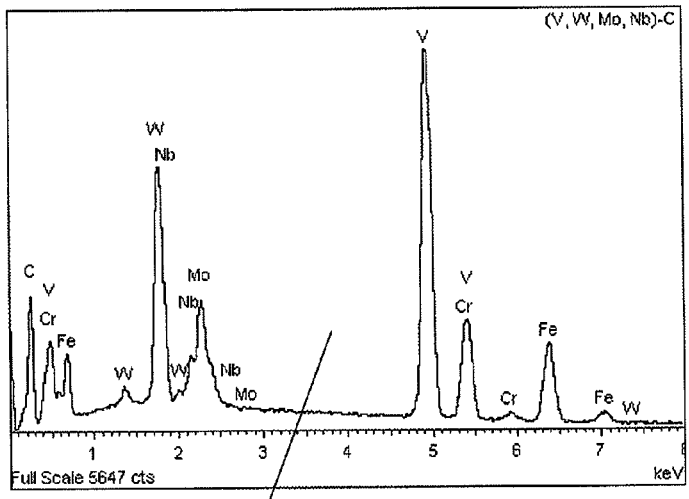
FIG. 5 and FIG. 5A show the formation and the composition of carbides which have been produced during a nucleation action of NbC in a material in accordance with the present invention.
Figure 5:
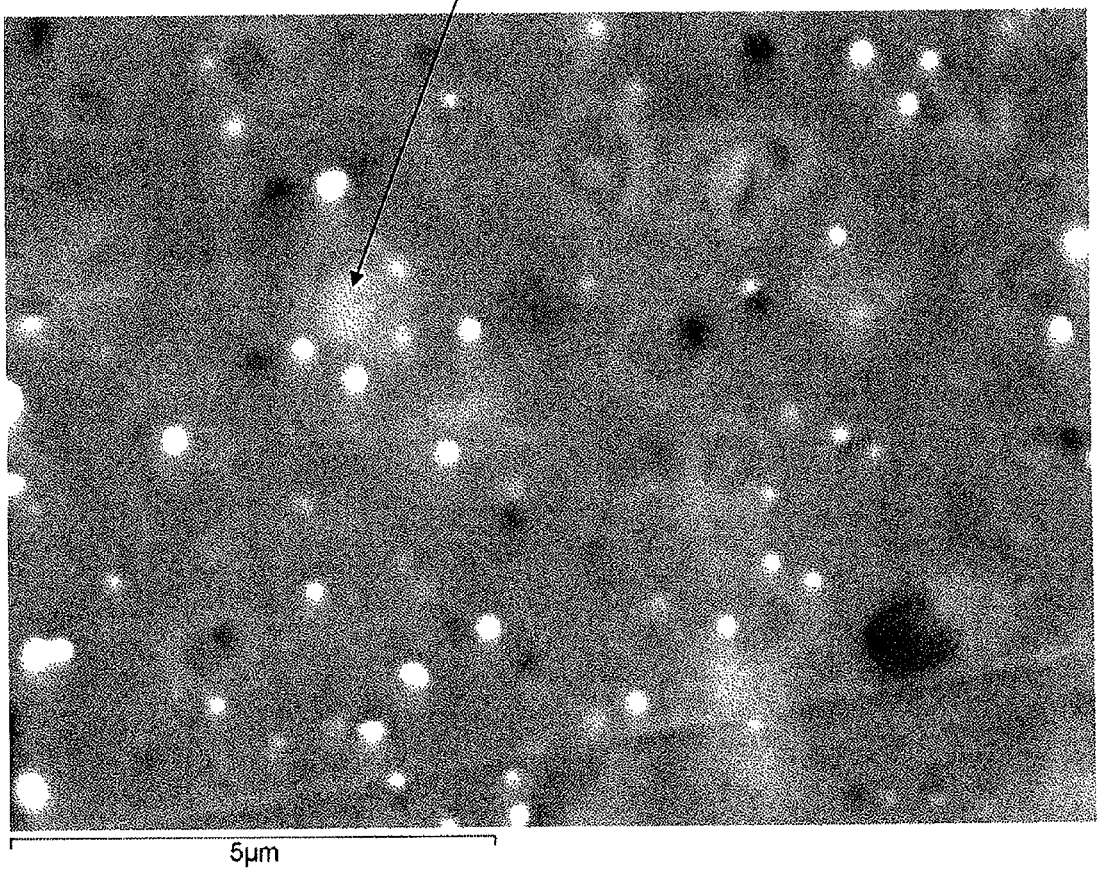

FIG. 5 and FIG. 5A show the formation and the composition of carbides which have been produced during a nuclear action of NbC. As FIG. 5 shows, the tungsten-molybdenum carbides appearing with high brightness are smaller and more precisely defined based on the matrix. In contrast thereto, the vanadium-tungsten-molybdenum-niobium carbides (which are shown slightly brighter) are embodied with broad transition to the matrix. The examination of the carbide composition shows, as can be seen from FIG. 5A, the nuclear action of NbC in the carbide formation.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A cold-forming steel article, wherein the article comprises an alloy which comprises, in % by weight:

C from about 1.1 to about 1.7
Mn from about 0.1 to about 0.6
Si from about 0.4 to about 1.1
Cr from about 5.6 to about 7.0
Mo from about 1.2 to about 1.8
V from about 3.5 to about 3.9
W from about 1.1 to about 5.0 and optionally niobium as well as less than about 0.4 wt. % of accompanying elements, the remainder being iron and contaminants, and wherein the article has been formed by a process comprising atomization of a melt to form a powder and hot isostatic pressing (HIP) of the powder, and wherein the article has been hardened by a heat treatment and exhibits a material hardness of at least 60 HRC and a material toughness of higher than 50 J.

2. The article of claim 1, wherein the alloy comprises up to about 1.0 wt. % of Nb with the proviso that $W_{Nb}$ is lower than about 88, $W_{Nb}$ being defined as $$W_{Nb} = \frac{(Mo + W/2) + V}{Nb}.$$

3. The article of claim 1, wherein the alloy comprises in % by weight, at least one of:

C=from more than 1.2 to less than 1.6
Mn=from more than 0.2 to less than 0.55
Si=from more than 0.45 to less than 1.0
Cr=from more than 5.7 to less than 6.9
Mo=from more than 1.3 to less than 1.7
V=from more than 3.55 to less than 3.9
W=from more than 1.9 to less than 4.5
Nb=from more than 0.1 to less than 0.9.

4. The article of claim 1, wherein the alloy comprises in % by weight, at least one of:

C=from about 1.35 to about 1.55
Mn=from about 0.3 to about 0.5
Si=from about 0.5 to about 0.9
Cr=from about 5.8 to about 6.5
Mo=from about 1.4 to about 1.6
V=from about 3.6 to about 3.8
W=from about 3.1 to about 4.4
Nb=from about 0.4 to about 0.75.

5. The article of claim 2, wherein the alloy comprises in % by weight:

C=from 1.35 to 1.55
Mn=from 0.3 to 0.5
Si=from 0.5 to 0.9
Cr=from 5.8 to 6.5
Mo=from 1.4 to 1.6
V=from 3.6 to 3.8
W=from 3.1 to 4.4
Nb=from 0.4 to 0.75.

6. The article of claim 1, wherein the article has a coating on a surface thereof, which coating has been applied during tempering at a temperature of at least about 500° C.

7. The article of claim 6, wherein the coating comprises a hard material coating.

8. The article of claim 7, wherein the hard material coating comprises at least one of a nitride, carbonitride, and oxide-carbide of one or more of Ti, Cr and Al.

9. The article of claim 1, wherein the article exhibits a material hardness of greater than 62 HRC.

10. The article of claim 1, wherein the article exhibits a material hardness of from 63 to 65 HRC.

11. The article of claim 1, wherein the article exhibits a material toughness of greater than 60 J.

12. The article of claim 10, wherein the article exhibits a material toughness of greater than 65 J.

13. The article of claim 5, wherein the article comprises a hard material coating on a surface thereof, which coating has been applied at a temperature of at least about 550° C.

14. The article of claim 1, wherein the article comprises a tool.

15. A process for making a cold-forming steel article, wherein the process comprises atomization of an alloy melt to form a powder and hot isostatic pressing (HIP) of the powder and hardening the article by a heat treatment to a material hardness of at least 60 HRC and a material toughness of higher than 50 J, the alloy comprising, in % by weight:

C from about 1.1 to about 1.7
Mn from about 0.1 to about 0.6
Si from about 0.4 to about 1.1
Cr from about 5.6 to about 7.0
Mo from about 1.2 to about 1.8
V from about 3.5 to about 3.9
W from about 1.1 to about 5.0 and optionally niobium as well as less than about 0.4 wt. % of accompanying elements, the remainder being iron and contaminants.

16. The process of claim 15, wherein the process further comprises hot forming of the article before hardening it.

17. The process of claim 15, wherein the process further comprises applying a coating on a surface of the article during tempering at a temperature of at least about 500° C.

18. The process of claim 17, wherein the temperature is at least about 550° C.

19. The process of claim 17, wherein the coating comprises a hard material coating.

20. The process of claim 15, wherein the article exhibits a material hardness of at least 63 HRC and a material toughness of greater than 60 J.

* * * * *